US007363665B2

(12) United States Patent
Polevoy et al.

(10) Patent No.: US 7,363,665 B2
(45) Date of Patent: Apr. 29, 2008

(54) BED FRAME WITH EXTENDED BUMPER ASSEMBLY

(75) Inventors: Richard S. Polevoy, Teaneck, NJ (US); Paul Eric Carlson, Skaneateles, NY (US); Howard Scott Ryan, Skaneateles, NY (US)

(73) Assignee: Finger Lakes Intellectual Property, LLC, Teaneck, NJ (US)

( * ) Notice: Subject to any disclaimer, the term of this patent is extended or adjusted under 35 U.S.C. 154(b) by 0 days.

(21) Appl. No.: 11/129,036

(22) Filed: May 13, 2005

(65) Prior Publication Data

US 2005/0278858 A1 Dec. 22, 2005

Related U.S. Application Data

(60) Provisional application No. 60/570,699, filed on May 14, 2004.

(51) Int. Cl.

| | |
|---|---|
| ***A47C 19/00*** | (2006.01) |
| ***A47C 19/02*** | (2006.01) |
| ***A47C 21/00*** | (2006.01) |
| ***A47C 31/00*** | (2006.01) |

(52) U.S. Cl. ..... 5/200.1; 5/201; 5/286; 5/663; 5/907

(58) Field of Classification Search ..... 5/200.1, 5/201, 663, 907, 282.1, 285, 286
See application file for complete search history.

(56) References Cited

U.S. PATENT DOCUMENTS

| | | | | |
|---|---|---|---|---|
| 1,431,976 | A * | 10/1922 | Mintz | 5/200.1 |
| 2,951,252 | A * | 9/1960 | Roche | 5/279.1 |
| 3,546,725 | A * | 12/1970 | Tambascio | 5/200.1 |
| 3,761,970 | A * | 10/1973 | Fredman | 5/181 |
| 3,761,971 | A * | 10/1973 | Behnke | 5/201 |
| 3,914,810 | A * | 10/1975 | Harris | 5/286 |
| 3,950,797 | A * | 4/1976 | Bronstien, Jr. | 5/200.1 |
| 4,135,266 | A * | 1/1979 | Knoke | 5/201 |
| 4,598,434 | A * | 7/1986 | Mis | 5/200.1 |
| 4,670,922 | A * | 6/1987 | Mis | 5/200.1 |
| 4,870,711 | A * | 10/1989 | Felix | 5/200.1 |
| 5,894,614 | A * | 4/1999 | Stroud | 5/200.1 |
| 2003/0097714 | A1* | 5/2003 | Polevoy et al. | 5/663 |
| 2004/0194217 | A1* | 10/2004 | Polevoy et al. | 5/663 |
| 2005/0278858 | A1* | 12/2005 | Polevoy et al. | 5/663 |
| 2007/0044235 | A1* | 3/2007 | Navarro et al. | 5/201 |

FOREIGN PATENT DOCUMENTS

WO WO 9015555 A1 * 12/1990

* cited by examiner

*Primary Examiner*—Robert G. Santos
(74) *Attorney, Agent, or Firm*—Klauber & Jackson L.L.C.

(57) ABSTRACT

A bed frame having a bumper assembly that can be added to the foot end of the bed frame in order to extend the length of the bed frame fully support the box spring and mattress. The bumper assembly can be factory installed or provided as a kit to install on site and includes a rigid straight member and curved ends dimensioned and radiused to surround the box spring. An extender rail is also optionally added to the normal center beam and affixed to support the rigid straight member. The extender rail can have a leg that supports the extender rail from the floor and that support thereby includes a support for the bumper assembly. The completed bed frame with the extender assembly also can have various protective members affixed thereto in order to provide protection to a user as well as improve the overall appearance of the bed frame.

12 Claims, 5 Drawing Sheets

BED FRAME WITH EXTENDED BUMPER ASSEMBLY

CROSS-REFERENCE TO RELATED APPLICATIONS

The present application is based upon U.S. Provisional Patent Application 60/570,699, filed May 14, 2004 and entitled "BED FRAME WITH EXTENDED BUMPER ASSEMBLY".

BACKGROUND OF THE INVENTION

The present invention relates to bed frames, and, more particularly, to a bed frame having a foot end extended frame.

In general, bed frames are comprised of a pair of side rails and a plurality of cross rails that span between the side rails in order to assemble and complete the bed frame structure. The bed frame, once assembled is adapted to support a box spring and a mattress to make up the bed itself. Normally, therefore, the conventional bed frame assembly is shipped and delivered unassembled for convenience and general transportation.

There is also, normally, a center beam that is positioned so as to be generally parallel to the side rails and which is located at or near the center of the bed frame in order to provide additional support to the overall structure and, of course to the box spring and mattress. The center beam is added to the bed frame to span between the cross rails in order to prevent the further relative movement between the cross rail members as well as to secure the center beam into the bed frame to finalize the task of assembling that bed frame.

Conventionally, with a bed frame, the side rails are constructed of metal members and are dimensioned so as to provide support substantially along the entire length of a box spring, however, the cross rails are located inboard of the ends of the side rails and the side rail themselves terminate short of the length of the box spring and mattress. As such, the ends of the box spring and mattress at the head and foot of the bed are unsupported. While the unsupported end normally does not matter at the head of the bed inasmuch as that end is generally against a wall and/or has a headboard attached thereto, at the foot end of the bed, the lack of support, however, can be a problem since persons tend to sit on that unsupported foot end of the mattress and can cause problems with the box spring and mattress.

The problem is exacerbated with a wider bed and, in the case of split queen and king size beds, since the box springs are configured in two parts. In addition, the standard metal frames with side rails that terminate short of the mattress set suffer from an incomplete appearance and, compared to a traditional wood bed or platform bed, the ends of the metal beds are open and have an unfinished appearance.

It would thus be advantageous to have an extension that can be added to the standard metal bed frame to extend the support at the foot end of the bed frame so as to provide additional support to the box spring and mattress as well as present a pleasing appearance to the metal bed frame.

SUMMARY OF THE INVENTION

Now, in accordance with the present invention, there is provided a bed frame that includes a bumper assembly that attaches to the distal footboard ends of the side rails in order to add a rail member that conforms generally to the foot end of a box spring.

The rail member comprises a rigid straight member and a pair of curved ends that are affixed to the ends of the side rails and, in an embodiment, the rigid straight member is a T-shaped component having the curved ends constructed of stamped sheet metal.

The bumper assembly can also, optionally, have a leg that extends downwardly to contact the floor so as to provide support for the bumper assembly and aid in the support of the box spring and mattress.

Thus, with the present invention, the bed frame is better appearing and has a finished look as well as providing support for the foot end of the mattress and box spring. The curved ends can be attached to the side rails by a number of illustrated methods to secure that rail member firmly to the side rails. The present bumper assembly can also be used with various types of bed frames including conventional bed frames having L-shaped angle iron side rails or other conventional types of bed frames.

Other features of the present bed frame with the bumper assembly affixed thereto will become more apparent in light of the following detailed description of a preferred embodiment thereof and as illustrated in the accompanying drawings.

BRIEF DESCRIPTION OF THE DRAWINGS

FIGS. 4A, 4B and 4C are, respectively, a top view, side view and cross sectional view of an alternative embodiment of the present invention.

DETAILED DESCRIPTION OF THE INVENTION

Figure 1:
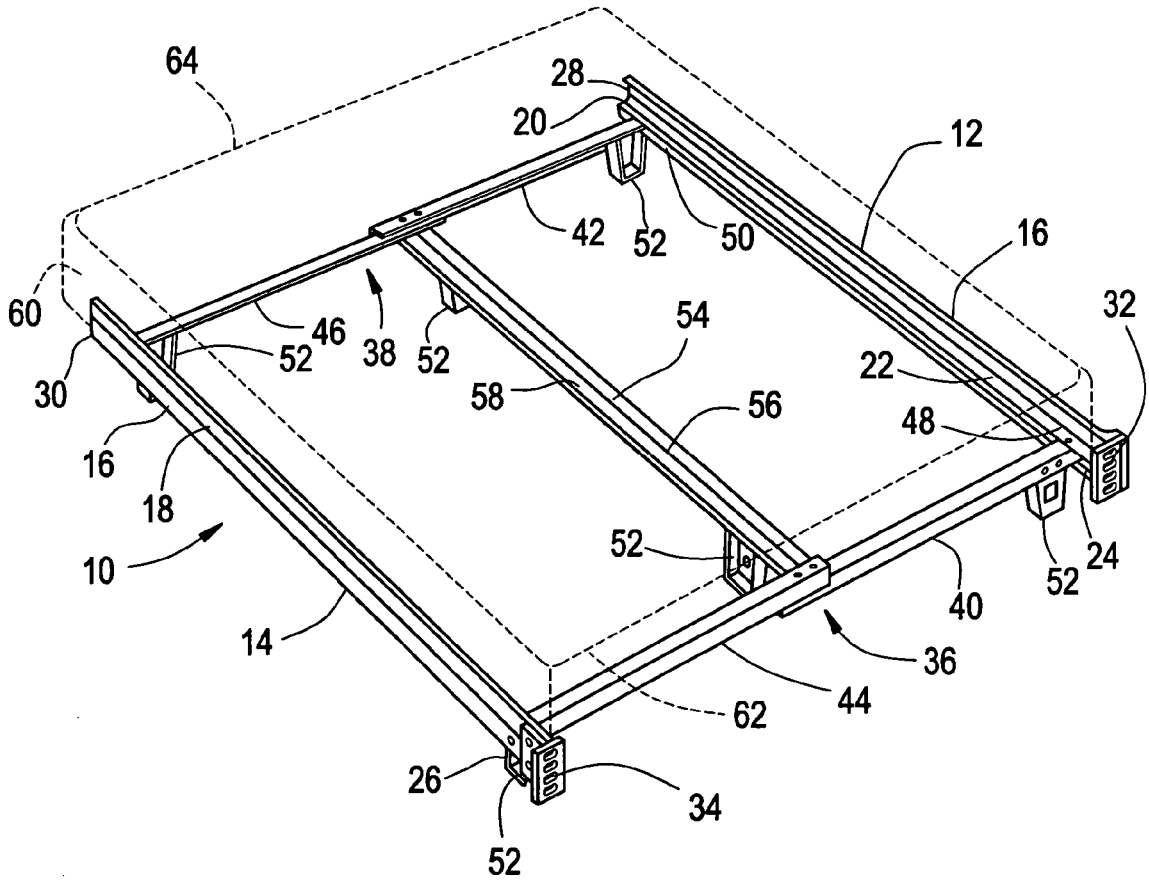
FIG. 1 is a perspective view of an adjustable width folding bed frame for supporting a box spring and mattress.

Referring now to FIG. 1, there is shown a perspective view of an adjustable width folding bed frame 10. In the Figure, there are a pair of side rails 12, 14 that have a T-shaped cross section, rotated 90 degrees from a normal T. Thus the T-shaped side rails 12, 14 have the large flat vertical flanges 16 forming exterior surfaces 18 with horizontal flanges 20 extending inwardly from the vertical flanges 16 forming upper surfaces 22 and located about midway between the outer edges of the vertical flanges 16. The side rails 12, 14 have headboard ends 24, 26 respectively and footboard ends 28, 30 respectively. At the headboard ends 24, 26, there are normally located headboard brackets 32, 34 to aid in the attachment of a headboard to the side rails 12, 14.

To make up the bed frame 10, there are also cross rails 36, 38 comprised of cross rail members 40, 42, 44 and 46 that extend outwardly from side rails 12, 14 at about a right angle. As explained, for the convenience of handling and transportation of the components of a bed frame 10, the cross rail members 40, 42, 44, 46 are pivotally mounted to the side rails 12, 14, that is, cross rail members 40 and 42 are pivotally mounted at junction points 48, 50 to side rail 12 while cross rail members 44 and 46 are pivotally mounted at junction points (not shown in FIG. 1) to side rail 14. As an example, therefore, during shipment, the cross rail members 40 and 42 are positioned 90 degrees from the orientation shown in FIG. 1 and rest parallel to and abut against the side rail 12 and, during assembly, the cross rail members 40 and 42 are rotated about 90 degrees to the position as shown.

Legs 52 extend downwardly from each of the cross rail members 40, 42, 44, 46 generally at or near the junction points between the cross rail members 40, 42, 44 and 46 and the side rails 12, 14 and the legs 52 thereby provide the support for the bed frame 10 after the assembly thereof. The legs 52 may be provided with glides or rollers (not shown) that contact the floor. As can be seen the legs 52 are mounted to the cross rails 36, 38 proximate to the junction points 48, 50 between the cross rails 36, 38 and the side rail 12 but displaced inwardly a finite distance. The same is true of the location of the legs 52 that extend downwardly from the cross rail members 44, 46. In addition, it also can be seen that the cross rail 38 is affixed to the side rail 12, 14 at junction point 50 and that the side rails 12, 14 extend in a cantilever manner further outwardly from those junction points to reach the footboard ends 28, 30 of side rails 12, 14.

In addition, there is also a center beam 54 that is affixed to and spans the cross rails 36, 38 and is positioned to be generally parallel to the side rails 12, 14. That affixation of the center beam 54 to the cross rails 36, 38 may be by bolts and nuts in a conventional manner. The center bean 54 is configured as an upright T-shape with the large horizontal flange 56 providing an upper surface 58.

There is also shown in phantom lines in FIG. 1, a box spring 60 that sits atop of the upper surface 22 of the horizontal flanges 20 of side rails 12, 14 as well as the upper surface 58 of the center beam 54 and in making a bed, a mattress normally sits atop of the box spring 60. As can be seen, there is a head end 62 and a foot end 64 of the box spring 60. The foot end 64 can be seen to extend beyond the footboard ends 28 and 30 of the side rails 12, 14 and further beyond the support provided by the cross rail 38 such that there basically is no support to the foot end 64 of the box spring 60. As such, someone sitting on the end of a mattress can cause the foot end 64 of the box spring 60 to bend downwardly potentially harming the box spring 60 or lifting the head end 62 of the box spring 60 from the bed frame 10.

Figure 2A:
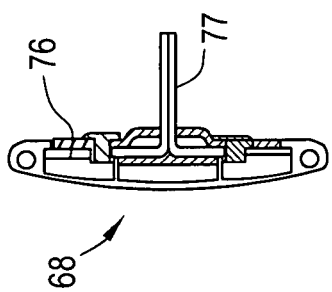
FIG. 2 is a partially exploded view of a bed frame showing the bumper assembly of the present invention and FIG. 2A is a cross sectional view of a component taken alone the line 2A-2A of FIG. 2.
Figure 2:
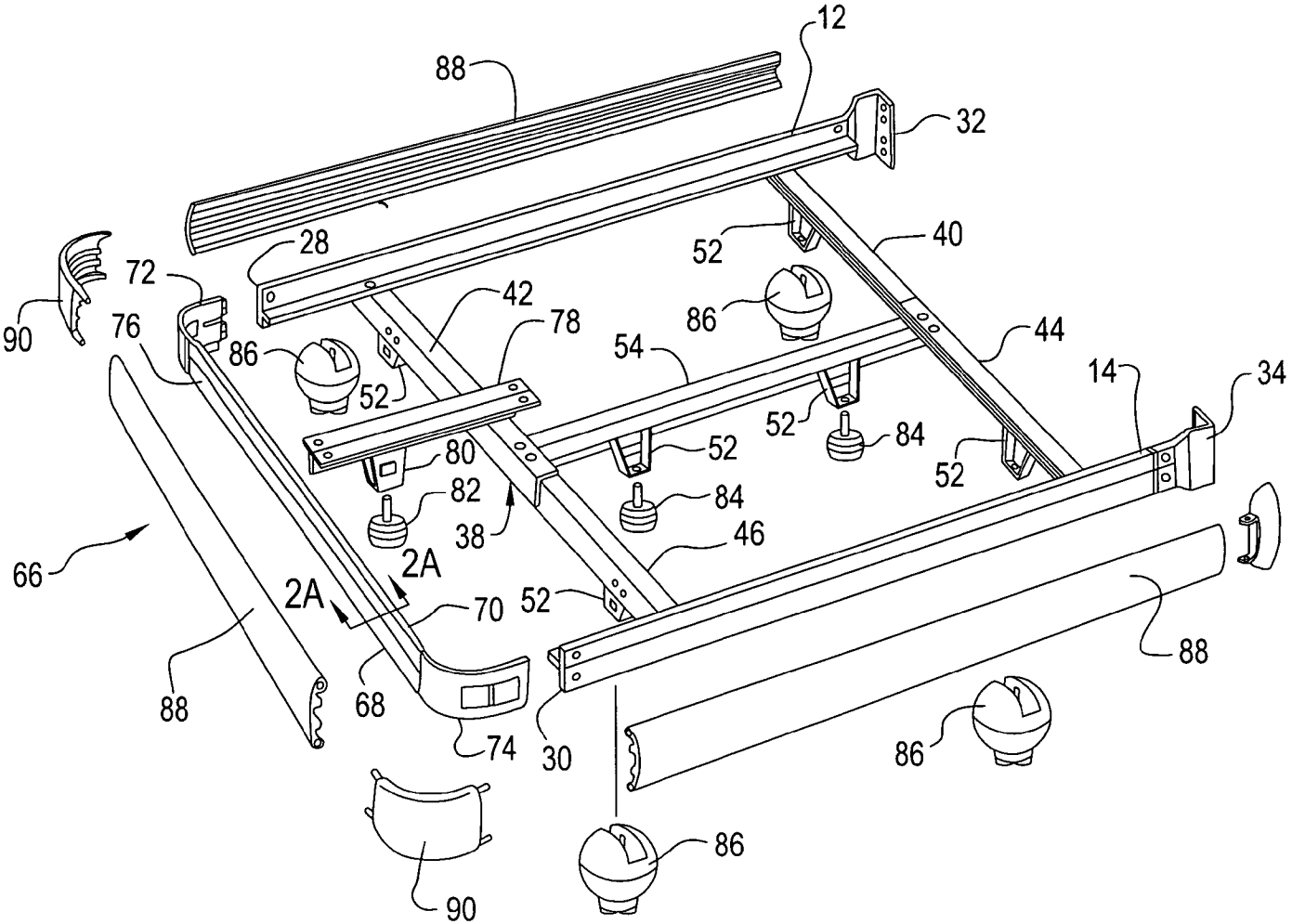

Turning then to FIG. 2, there is shown a partially exploded view of a bumper assembly 66 of the present invention and which is affixed to the side rails 12, 14 in order to provide support for the overhanging box spring and mattress at the foot end of the bed frame 10. The bumper assembly 66 can be pre-assembled by the bed frame manufacturer or provided as a kit to be assembled from parts and components supplied by the manufacturer. The bumper assembly 66 comprises a rail member 68 that is affixed to the footboard end 28, 30 of the side rails 12, 14 and that rail member 68 is, in turn, comprised of a rigid straight member 70 and a pair of curved ends 72, 74. The rigid straight member 70 has a T-shaped cross section oriented and constructed in the same manner as the side rails 12, 14, that is, there is a vertical flange 76 facing outwardly and a horizontal flange 77 shown in FIG. 2A) directed inwardly and extending from the midpoint between the outer edges of the vertical flange 76.

As will be seen, the curved end 72 is affixed to the footboard end 28 of side rail 12 and the curved end 74 is affixed to the footboard end 30 of the side rail 14. The other ends of the curved ends 72, 74 are affixed to the rigid straight member 70 and may be by bolts and nuts or rivets in a conventional manner. The radius of curvature of the curved ends 72, 74 can be designed so as to closely follow the curvature of a typical box spring such that the overall completed bed frame conforms generally to the outer configuration of the box spring 60 (FIG. 1).

There is also an extender rail 78 that spans between the cross rail 38 and the rigid straight member 70 and, again the manner of affixing the extender rail 78 can be by means of bolts and nuts. The addition and use of an extender rail 78 is optional as the structure of the bumper assembly 66 is itself, in most cases, is sufficiently strong to not require the added support of the extender rail 78. A leg 80 extends downwardly from the extender rail 78 for support and that leg 80 contacts the floor through a caster 82. The caster 82 can be of the type shown and described in U.S. Pat. No. 6,568,031 of Polevoy et al, and the disclosure of that patent is hereby incorporated herein in its entirety by reference. The same casters 84 can be used to support the center beam 54 and are attachable to the legs 52. Thus, there is support for the extender rail 78 from the floor and which also, therefore, provides support to the rail member 68 by the connection of the extender rail 78 to the rigid straight member 70.

In order to improve the safety as well as the appearance of the bed frame 10 with the bumper assembly 66 affixed thereto, those legs 52 that can be potentially struck by a passerby are protected with leg protective members 86 constructed and installed in accordance with that shown and described in U.S. Pat. No. 6,418,578 of Polevoy et al and the disclosure of that patent is hereby incorporated herein in its entirety by reference. In addition, the side rails 12, 14 and the rigid straight member 70 can be covered by snap-on protective members 88 constructed in accordance with U.S. patent application Ser. No. 09/997,389 and the disclosure of that patent application is hereby incorporated herein in its entirety by reference. There can also be used, corner protective members 90 having pins 92 that enable the comer protective members 90 to interfit with adjacent snap-on protective members 88.

Figure 3B:
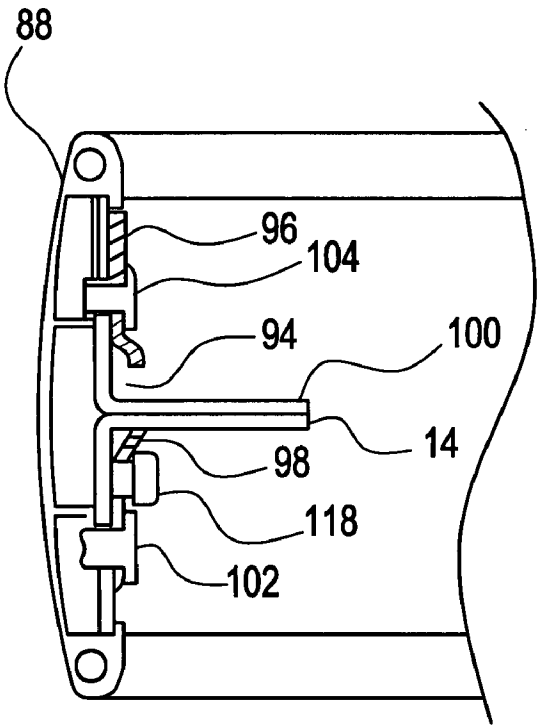
FIG. 3A is a side view of an illustrative embodiment of the present invention and FIG. 3B is a cross sectional view of that embodiment taken along the line 3B-3B of FIG. 3A.
Figure 3A:
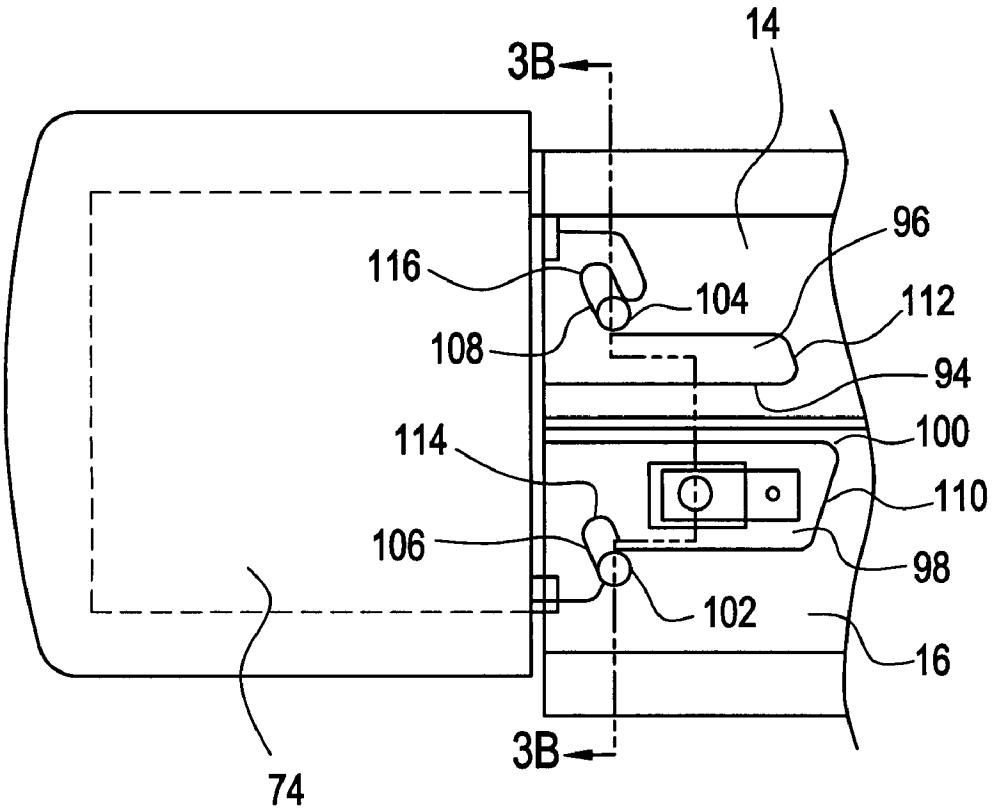

Turning now to FIGS. 3A and 3B, there are shown a side view and a cross sectional view taken along the line 3B-3B of FIG. 3A, respectively, and illustrating a mechanism that can be used to affix, for example, the curved end 74 to the side rail 14. In the Figs, the curved end 74 has a bifurcated flange that extends outwardly therefrom thereby forming a horizontal slot 94 that creates an upper flange member 96 and a lower flange member 98. When the curved end 74 is slid onto the side rail 14, the upper and lower flange members 96, 98 straddle the horizontal flange 100 of the side rail 14 such that the horizontal flange 100 enters and resides within the horizontal slot 94. A pair of standoff rivets 102, 104 are affixed to the vertical flange 16 of the side rail 14 with one above and one below the horizontal flange 100. The upper and lower flange members 96, 98 also have angled slots 106, 108 that are oriented so as to form an acute angle leading away from the distal ends 110, 112 of the upper and lower flange members 96, 98. As seen in FIG. 3A, the standoff rivets 102, 104 are shown to be just entering the angled slots 106, 108. Thus as the curved end 74 is released or pushed further inwardly, the curved end 74 will move downwardly and seat the standoff rivets 102, 104 at the closed ends 114, 116 of the angled slots 106, 108 to seat the curved end 74 and thereby affix it firmly to the side rail 14.

To retain the curved end 74 in that seated position, there may be a spring loaded button 118 that passes through suitably located holes in both the lower flange member 98 and the vertical flange 16 so as to retain the curved end 74 to the side rail 14.

Figure 4A:
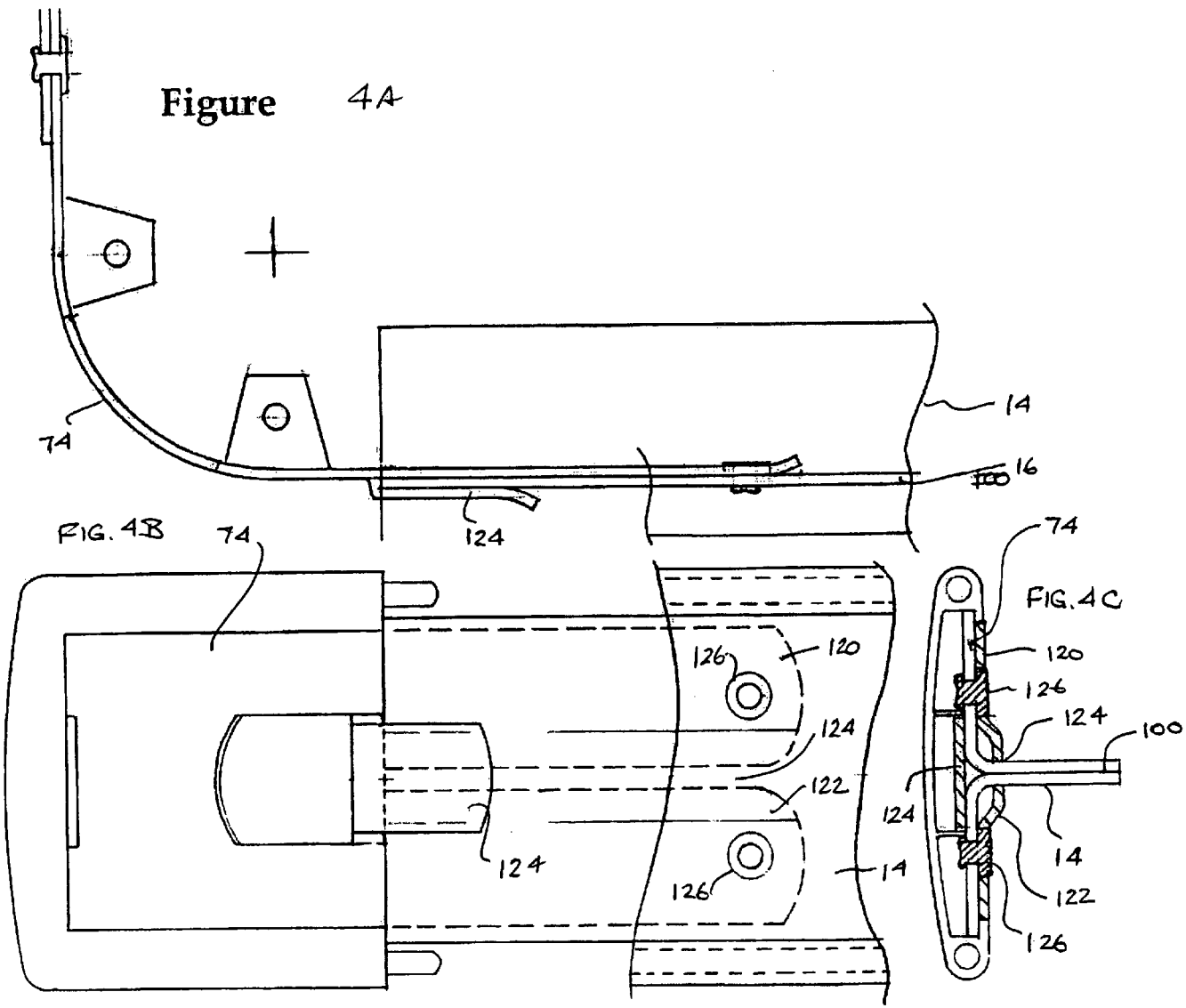

Turning now to FIGS. 4A, 4B and 4C, there is shown a top view, a side view and a cross sectional view, respectively, of an alternative mechanism for affixing the curved end 74 to the side rail 14. In this embodiment, there are a pair of upper and lower prongs 120, 122 that, again form a slot 124 that straddles the horizontal flange 100 of the side rail 14. In this embodiment, the upper and lower prongs 120, 122 extend along the inner surface of the vertical flange 16 of the side rail 14 while there is an external prong 124 that extends along the outer surface of the vertical flange 16. The upper and lower prongs 120, 122 are affixed to the vertical flange 16 by means such as pins 126, that pass through holes formed in the upper and lower prongs 120, 122 thereby affixing the curved end 74 to the side rail 14.

Figure 5:
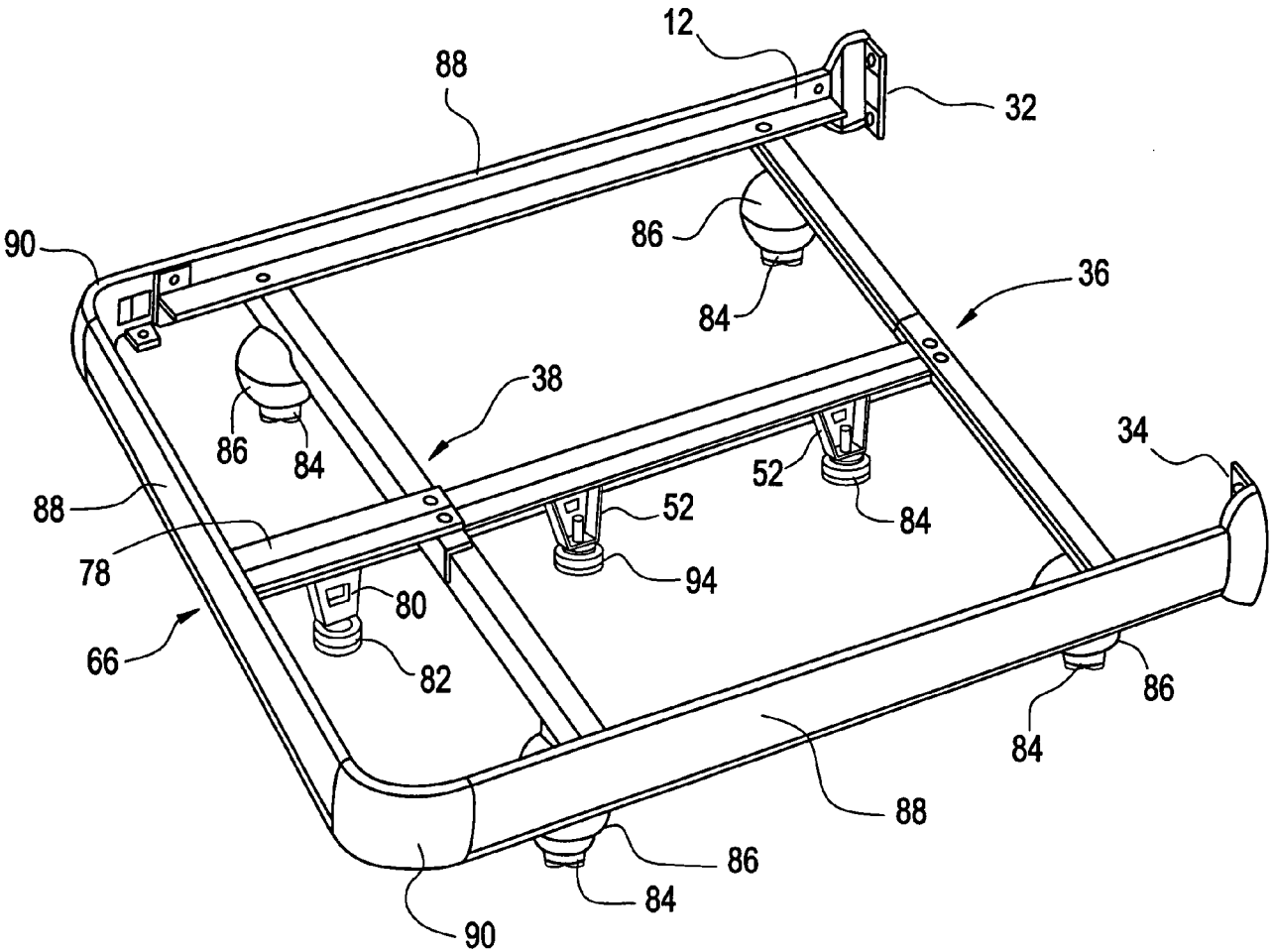
FIG. 5 is a perspective view of a completed bed frame utilizing the present invention.

Thus, turning finally to FIG. 5, there is shown a perspective view of a completed bed frame 10 constructed in accordance with the present invention with the various protective members in place to provide an overall pleasing appearance and added safety features. Accordingly, as can be seen, the bed frame 10 includes the bumper assembly 66 supported by the leg 80 and caster 82 the contacts the floor. The overall appearance is enhanced by the use of the protective members 88 that cover the principle components as well as the corner protective members 90 and the leg protective members 86. The curvature of the curved ends 72, 74 are determined so as to conform to the arcuate corners of a box spring so that a box spring fits into the bed frame 10 and the outside periphery of the bed frame 10 generally fits closely around that box spring to provide a neat, finished appearance and which also provides the needed support the foot end of a box spring and mattress.

While the present invention has been set forth in terms of a specific embodiment of embodiments, it will be understood that the present bed frame having a bumper assembly herein disclosed may be modified or altered by those skilled in the art to other configurations. Accordingly, the invention is to be broadly construed and limited only by the scope and spirit of the claims appended hereto.

We claim:

1. A bed frame assembly comprising:

a pair of generally parallel, spaced apart side rails having a horizontal surface for supporting a box spring and a mattress, said pair of side rails each having foot ends and head ends, opposed cross rails having a horizontal surface for supporting a box spring and mattress interconnecting and spanning between said side rails, said cross rails having ends connected to said side rails at junctions displaced inwardly from said foot ends and head ends of said side rails to form a generally square bed frame with said side rails extending outwardly beyond said cross rails at said foot end of said bed frame assembly, a leg assembly affixed proximate to the ends of said cross rails, a bumper assembly affixed to the foot ends of said side rails, said bumper assembly having a rail member adapted to surround and support the end of a box spring when supported on said bed frame wherein the rail member is made primarily of a T-shaped cross section having a vertical flange and a horizontal flange and comprises a rigid straight member and having curved ends attached to the frame side rails, said curved ends conforming generally to the curved corners of a box spring.

2. A bed frame assembly as defined in claim 1 wherein said rigid straight member is constructed of an angle iron.

3. A bed frame assembly as defined in claim 1 wherein the curved ends of said rail member are constructed of stamped sheet metal.

4. A bed frame assembly as defined in claim 1 wherein the rail member is contained by a decorative and protective plastic covering.

5. A bed frame assembly as defined in claim 4 wherein said decorative and protective plastic covering is preinstalled on the side rails.

6. A bed frame assembly as defined in claim 1 wherein said bumper assembly further includes at least one leg extending downwardly therefore to contact a floor to provide support for said rail member.

7. A bed frame assembly as defined in claim 6 wherein said bumper assembly includes an extender rail affixed to said rigid straight member and said at least one leg extends downwardly from said extender rail to contact a floor as support for said bumper assembly.

8. A bed frame assembly as defined in claim 1 wherein the curved ends are constructed of stamped sheet metal and each have at least one hook to interconnect with a matching pin on the side rails to connect the rail member to the side rails.

9. A bed frame assembly as defined in claim 8 wherein the curved ends each have a pivoting plate that locks the at least one hook onto the matching pins to prevent inadvertently disconnecting of the rail member from the side rails.

10. A bed frame assembly as defined in claim 1 wherein the curved ends are in the form of a bracket having three prongs, wherein two of the prongs attach onto opposite sides of the horizontal flange of the side rail and one prong that rests against the exterior of the vertical flange.

11. A bed frame assembly as defined in claim 10 wherein the curved ends have holes on at least one prong that corresponds with one pin on the side rail to avoid inadvertently disconnecting of the rail member.

12. A bed frame assembly as defined in claim 1 wherein the bumper assembly is removably affixed to the side rails.

* * * * *